US012351962B2

(12) United States Patent
Ogawa et al.

(10) Patent No.: US 12,351,962 B2
(45) Date of Patent: Jul. 8, 2025

(54) SEWING MACHINE

(71) Applicant: JUKI CORPORATION, Tokyo (JP)

(72) Inventors: Tatsuya Ogawa, Tokyo (JP); Takahiro Higa, Tokyo (JP); Kuniaki Sato, Tokyo (JP); Hajime Nakayama, Tokyo (JP); Juan Zhang, Tokyo (JP)

(73) Assignee: JUKI CORPORATION, Tokyo (JP)

( * ) Notice: Subject to any disclaimer, the term of this patent is extended or adjusted under 35 U.S.C. 154(b) by 0 days.

(21) Appl. No.: 18/522,155

(22) Filed: Nov. 28, 2023

(65) Prior Publication Data

US 2024/0175186 A1 May 30, 2024

(30) Foreign Application Priority Data

Nov. 29, 2022 (JP) ..... 2022-190097

(51) Int. Cl.

| | |
|---|---|
| ***D05B 69/12*** | (2006.01) |
| ***D05B 1/12*** | (2006.01) |
| ***D05B 27/10*** | (2006.01) |
| ***D05B 29/02*** | (2006.01) |
| ***D05B 57/10*** | (2006.01) |

(52) U.S. Cl.

CPC ..... *D05B 69/12* (2013.01); *D05B 1/12* (2013.01); *D05B 27/10* (2013.01); *D05B 29/02* (2013.01); *D05B 57/10* (2013.01)

(58) Field of Classification Search

CPC .... D05B 69/12; D05B 1/12; D05B 27/10–16; D05B 29/02; D05B 57/10

See application file for complete search history.

(56) References Cited

U.S. PATENT DOCUMENTS

| | | | | |
|---|---|---|---|---|
| 3,425,377 A | | 2/1969 | Scharmer, Jr. | |
| 3,460,494 A | | 8/1969 | Denker | |
| 3,800,719 A | * | 4/1974 | Rockerath | D05B 33/00 112/304 |
| 6,095,070 A | * | 8/2000 | Sahl | D05B 27/14 112/304 |

(Continued)

FOREIGN PATENT DOCUMENTS

| | | | | |
|---|---|---|---|---|
| CN | 101613912 A | * | 12/2009 | D05B 27/24 |
| CN | 107488942 A | * | 12/2017 | D05B 27/00 |

(Continued)

OTHER PUBLICATIONS

"Search Report of Europe Counterpart Application", issued on Mar. 18, 2024, p. 1-p. 7.

*Primary Examiner* — Ismael Izaguirre
(74) *Attorney, Agent, or Firm* — JCIPRNET

(57) ABSTRACT

A sewing machine includes: a sewing needle; a shuttle, cooperating with the sewing needle to form a seam; a pressing member, pressing a sewing object disposed at a sewing position immediately below the sewing needle; a feed mechanism, in which endless feed belts feeding the sewing object disposed at the sewing position from the sewing position along a first direction are disposed on two sides with respect to the sewing position in a second direction orthogonal to the first direction, and in which a belt drive part is provided; a needle drive part, provided separately from the belt drive part, and moving the sewing needle in the first direction; and a control part, exerting control so that the belt drive part and the needle drive part operate independently.

4 Claims, 5 Drawing Sheets

(56) References Cited

U.S. PATENT DOCUMENTS 6,123,039 A * 9/2000 Niino ..... D05B 29/08
112/235

FOREIGN PATENT DOCUMENTS

| | | | | | |
|---|---|---|---|---|---|
| CN | 215328680 | U | * | 12/2021 | |
| DE | 102004019001 | | | 12/2004 | |
| DE | 102006013772 | | | 9/2007 | |
| EP | 2138620 | A1 | * | 12/2009 | ..... D05B 27/24 |
| JP | 2004313609 | A | * | 11/2004 | |
| JP | 2017221644 | A | * | 12/2017 | ..... D05B 27/00 |
| JP | 2019212194 | | | 12/2019 | |

* cited by examiner

SEWING MACHINE

CROSS-REFERENCE TO RELATED APPLICATION

This application claims the priority benefit of Japan application no. 2022-190097, filed on Nov. 29, 2022. The entirety of the above-mentioned patent application is hereby incorporated by reference herein and made a part of this specification.

BACKGROUND

Technical Field

The disclosure relates to a sewing machine.

Description of Related Art

In the technical field related to sewing machines, a sewing machine referred to as the so-called lock-stitch sewing machine, as disclosed in Patent Document 1, is known.

PRIOR ART DOCUMENT(S)

Patent Document(s)

[Patent Document 1] Japanese Laid-open No. 2019-212194

In the sewing machine, when a sewing object is to be sewn, for example, there is a specification of feeding the sewing object in a state in which a sewing needle is withdrawn from the sewing object. In addition, in the sewing machine, when sewing is performed in a state in which sewing objects overlap, there is a specification of feeding the sewing objects together with the sewing needle, so that upper and lower sewing objects are not shifted. In the case of switching the two specifications, the task is difficult as extensive recombination is required.

The disclosure provides a sewing machine able to easily switch the specification of feeding the sewing object.

SUMMARY

An aspect of the disclosure provides a sewing machine. The sewing machine includes: a sewing needle, held by a needle bar and holding an upper thread to move reciprocally; a shuttle, holding a bobbin which is accommodated in a bobbin case and in which a lower thread is wound, and cooperating with the sewing needle to form a seam; a pressing member, pressing a sewing object disposed at a sewing position immediately below the sewing needle; a feed mechanism, in which endless feed belts feeding the sewing object disposed at the sewing position from the sewing position along a first direction are disposed on two sides with respect to the sewing position in a second direction orthogonal to the first direction, and in which a belt drive part is provided; a needle drive part, provided separately from the belt drive part, and moving the sewing needle in the first direction; and a control part, exerting control so that the belt drive part and the needle drive part operate independently.

DESCRIPTION OF THE EMBODIMENTS

According to the disclosure, the specifications of feeding the sewing object can be switched easily.

Embodiments according to the disclosure will be described below with reference to the drawings. However, the disclosure shall not be limited to the embodiments. In addition, the components in the embodiments described below include those that can be easily replaced by those skilled in the art, or those that are substantially the same.

A sewing machine 1 according to the embodiment is described. In the embodiment, the positional relationship of each component is described based on a local coordinate system defined in the sewing machine 1. The local coordinate system is defined by an XYZ orthogonal coordinate system. A direction parallel to X-axis in a predetermined plane is defined as the X-axis direction (second direction). A direction parallel to Y-axis within a predetermined plane perpendicular to X-axis is defined as the Y-axis direction (first direction). A direction parallel to Z-axis perpendicular to the predetermined planes is defined as the Z-axis direction. A direction of rotation about X-axis is defined as the OX direction.

Figure 1:
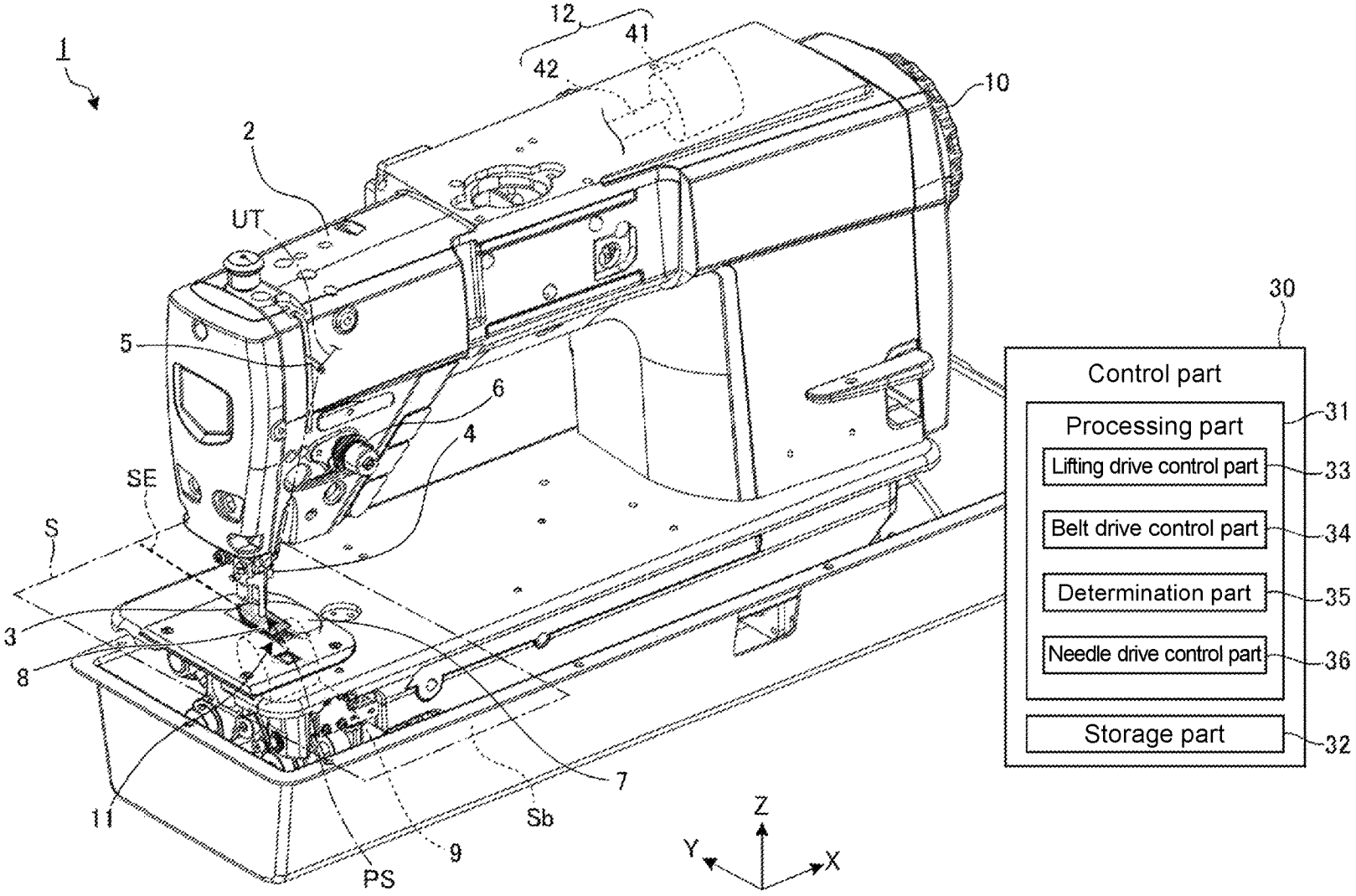
FIG. 1 is a schematic perspective view illustrating a sewing machine according to an embodiment.

FIG. 1 is a schematic perspective view illustrating the sewing machine 1 according to an embodiment. As shown in FIG. 1, the sewing machine 1 includes a sewing machine head 2, a needle bar 4, a take-up 5, a thread tensioner 6, a needle plate 7, a pressing member 8, a shuttle 9, a motor 10, a feed mechanism 11, a needle drive part 12, and a control part 30.

The needle bar 4 holds a sewing needle 3 and moves reciprocally in the Z-axis direction. The needle bar 4 holds the sewing needle 3 so that the sewing needle 3 is parallel to Z-axis. The needle bar 4 is supported by the sewing machine head 2. The needle bar 4 is disposed above the needle plate 7, and is able to face the surface of a sewing object S. An upper thread UT is threaded onto the sewing needle 3. The sewing needle 3 has a thread passing hole through which the upper thread UP passes. The sewing needle 3 holds the upper thread UT by using an inner surface of the thread passing hole. Through the reciprocal movement of the needle bar 4 in the Z-axis direction, the sewing needle 3 reciprocally moves in the Z-axis direction in a state of holding the upper thread UT.

The take-up 5 supplies the upper thread UT to the sewing needle 3. The take-up 5 is supported by the sewing machine head 2. The take-up 5 has a take-up hole through which the upper thread UT passes. The take-up 5 holds the upper thread UT by using an inner surface of the take-up hole. The take-up 5 moves reciprocally in the Z-axis direction in a state of holding the upper thread UT. The take-up 5 is linked with the needle bar 4 to move reciprocally. Through the reciprocal movement in the Z-axis direction, the take-up 5 lets out or pulls up the upper thread 5.

The thread tensioner (upper thread tension adjustment mechanism) 6 applies tension to the upper thread UT. The upper thread UT is supplied to the thread tensioner 6 from a thread supply source. On a passage that the upper thread UT passes through, the take-up 5 is disposed between the sewing needle 3 and the thread tensioner 6. The thread tensioner 6 adjusts the tension of the upper thread UT supplied to the sewing needle 3 via the take-up 5.

The needle plate 7 supports the sewing object S. The sewing needle 3 held by the needle bar 4 and the needle plate 7 are opposite to each other. The needle plate 7 has a needle hole that the sewing needle 3 is able to pass through. The sewing needle 3 that penetrates through the sewing object S supported by the needle plate 7 passes through the needle hole.

The pressing member 8 presses the sewing object S from the above. The pressing member 8 is supported by the sewing machine head 2. The pressing member 8 is disposed above the needle plate 7, and holds the sewing object S with respect to the needle plate 7.

The shuttle 9 holds a bobbin accommodated in a bobbin case. The shuttle 9 is disposed below the needle plate 7. The shuttle 9 rotates in the OX direction. The shuttle 9 is linked with the needle bar 4 to rotate. The shuttle 9 supplies a lower thread LT. The shuttle 9 scoops up the upper thread UT from the sewing needle 3 that penetrates through the sewing object S supported by the needle plate 7 and passes through the needle hole of the needle plate 7.

The motor 10 generates power. The motor 10 has a stator supported by the sewing machine head 2 and a rotor rotatably supported by the stator. Through the rotation of the rotor, the motor 10 generates power. The power generated by the motor 10 is transmitted to the needle rod 4, the take-up 5, and the shuttle 9, respectively, via a power transmission mechanism (not shown). The needle rod 4, the take-up 5, and the shuttle 9 are linked. By transmitting the power generated by the motor 10 to the needle rod 4, the needle rod 4 and the sewing needle 3 held by the needle rod 4 move reciprocally in the Z-axis direction. By transmitting the power generated by the motor 10 to the take-up 5, the take-up 5 is linked with the needle rod 4 to move reciprocally in the Z-axis direction. By transmitting the power generated by the motor 10 to the shuttle 9, the shuttle 9 is linked with the needle rod 4 and the take-up 5 to rotate in the OX direction. The sewing machine 1 sews the sewing object S through the cooperation of the sewing needle 3 held by the needle bar 4 and the shuttle 9.

The feed mechanism 11 delivers the sewing object S from a sewing position PS toward the Y-axis direction. In the embodiment, the feed mechanism 11 is disposed lower than the sewing object S disposed at the sewing position PS. A feed mechanism disposed higher than the sewing object S disposed at the sewing position PS may also be provided separately. The feed mechanism 11 has feed belts 21 and a belt drive part 22.

Figure 2:
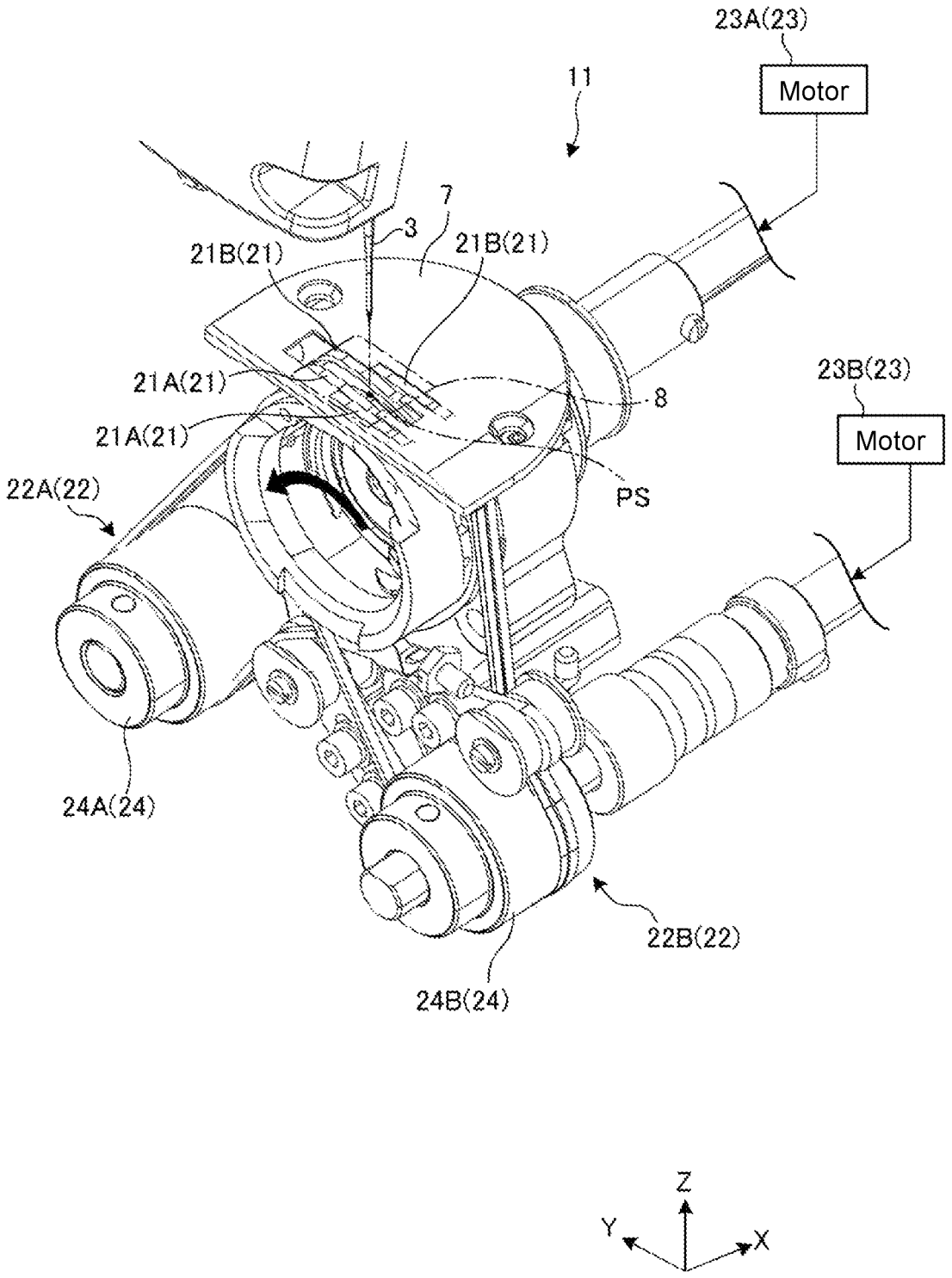
FIG. 2 is a view illustrating an example of a feeding mechanism.

FIG. 2 is a view illustrating an example of the feeding mechanism 11. As shown in FIG. 2, the feed belts 21 contact a back surface Sb of the sewing object S. The feed belt 21 is in a ring shape (endless). The feed belts 21 are disposed on two sides in the X-axis direction with respect to the sewing position PS. On each of the two sides in the X-axis direction with respect to the sewing position PS, two feed belts 21 are disposed. That is, a total of four feed belts 21 are disposed. In the following, the two feed belts 21 disposed on a side (−X side) in the X-axis direction with respect to the sewing position PS are represented as feed belts 21A, and the two feed belts 21 disposed on the other side (+X side) in the X-axis direction with respect to the sewing position PS are represented as feed belts 21B.

The belt drive part 22 independently drives the feed belts 21A on the −X side with respect to the sewing position and the feed belts 21B on the +X side with respect to the sewing position PS. The belt driving part 22 has a drive system 22A that drives the feed belts 21A on the −X side of the sewing position PS and a drive system 22B that drives the feed belts 21B on the +X side of the sewing position PS. The drive system 22A has a motor 23A and a sprocket 24A. The drive system 22B has a motor 23B and a sprocket 24B.

When the motors 23A, 23B operate, the belts 21A supported by the sprocket 24A and the belts 21B supported by the sprocket 24B rotate in the Y-axis direction. Through the rotation of the belts 21A, 21B, the sewing object S is delivered in the Y-axis direction.

Referring to FIG. 1 again, the needle drive part 12 moves the sewing needle 3 in the Y-axis direction. The needle drive part 12 has a motor 41 and a transmission mechanism 42. The motor 41 is provided separately from the motors 23A, 23B of the belt driving part 22. The transmission mechanism 42 transmits a drive force generated by the motor 41 to the sewing needle 3. The transmission mechanism 42 moves the sewing needle 3 in the Y-axis direction through a shaft and a timing belt not shown herein. The motor 41 and the transmission mechanism 42 are provided inside the sewing machine head 2.

The control part 30 collectively controls the operation of the sewing machine 1. The control part 30 has a processing part 31 and a storage part 32. The processing part 31 performs various information processing. The processing part 31 includes a processor, such as a central processing unit (CPU), and a memory, such as a read only memory (ROM), a random access memory (RAM).

The processing part 31 has a lifting drive control part 33, a determination part 35, a belt drive control part 34, and a needle drive control part 36.

The lifting drive control part 33 controls the movement of the sewing needle 3 in the Z-axis direction by controlling the rotation of the motor 10.

The determination part 35 determines the mode of feeding the sewing object S. The determination part 35 determines, for example, whether a belt feed mode is set or a needle feed mode is set. The belt feed mode is a mode that feeds the sewing object S in the Y-axis direction in a state in which the sewing needle 3 is withdrawn from the sewing object S. The needle feed mode is a mode that feeds the sewing object S and the sewing needle 3 in the Y-axis direction in a state in which the sewing needle 3 is stuck in the sewing object S. For example, in a case where sewing is performed in a state in which multiple sewing objects S overlap, the needle feed mode can suppress upper and lower objects in the upper-lower direction from being shifted in the horizontal direction.

The belt drive control part 34 controls the movement of the feed belts 21A, 21B toward the Y-axis direction by controlling the rotation of the motors 23A, 23B of the belt drive part 22. In the case where the transport mode of the sewing object S is set to the belt feed mode, the belt drive control part 34 controls the belt drive part 22, so that the feed belts 21 do not move in the Y-axis direction during the period in which the sewing needle 3 is stuck to the sewing object S, and the feed belts 21 move in the Y-axis direction during the period in which the sewing needle 3 is withdrawn from the sewing object S. In addition, in the case where the transport mode of the sewing object S is set to the needle feed mode, the belt drive control part 34 controls the belt drive part 21, so that the feed belts 21 moves the sewing needle 3 in the Y-axis direction by a predetermined distance during the period in which the sewing needle 3 is stuck to the sewing object S and the feed belts 21 do not move in the Y-axis direction during the period in which the sewing needle 3 is withdrawn from the sewing object S.

The needle drive control part 36 controls the movement of the sewing needle 3 in the Y-axis direction by controlling the rotation of the motor 41 of the needle drive part 12. In the case where the transport mode of the sewing object S is set to the belt feed mode, the needle drive control part 36 controls the needle drive part 12 so that the sewing needle 3 does not move in the Y-axis direction. In the case where the transport mode of the sewing object S is set to the needle feed mode, the needle drive control part 36 controls the needle drive part 12, so that the sewing needle 3 moves synchronously with the feed belts 21 by the predetermined distance in the Y-axis direction during the period in which the sewing needle 3 is stuck to the sewing object S and the sewing needle 3 does not move in the Y-axis direction during the period in which the sewing needle 3 is withdrawn from the sewing object S.

The storage part 32 stores information such as various programs, data. The storage part 32 includes a storage such as a hard disk drive (HDD), a solid state drive (SDD).

With the processor reading various programs and expanding the programs in the memory in the processing part 31, information processing corresponding to the functions of the respective parts is executed in the control part 30. Examples of the various programs may include programs stored in the storage part 32, programs recorded in an external recording medium, etc. The control part 30 serves as an information processing device (computer) executing various information processing. An information processing device other than the control part 13 may execute the various programs, or the control unit 30 and other information processing devices other than the control unit 30 may cooperate to execute the various programs.

In the following, the operation of the sewing machine 1 with such configuration is described. An operator places the sewing object S at the sewing position PS, and the sewing object S is arranged to be pressed by the pressing member 8. In such state, when the operator performs an operation to start sewing, the lifting drive control part 33 of the control part 30 controls the rotation of the motor 10 so that the sewing needle 3 reciprocally moves in the Z-axis direction. In addition, the belt drive control part 34 controls the feed amounts of the feed belts 21A, 21B by controlling the rotation of the motors 23A, 23B of the belt drive part 22. In addition, the needle drive control part 36 controls the movement of the sewing needle 3 in the Y-axis direction by controlling the rotation of the motor 41 of the needle drive part 12.

By operating an operation panel (not shown) provided in the sewing machine 1, for example, the operator can set the mode of feeding the sewing object S to the belt feed mode or the needle feed mode. In addition, the operator can switch the setting as appropriate by using the operation panel. In the control part 30, the determination part 35 determines the mode of feeding the sewing object S.

In the case where the determination part 35 determines that the belt feed mode is set, the belt drive control part 34 controls the belt drive part 22, so that the feed belts 21 do not move in the Y-axis direction during the period in which the sewing needle 3 is stuck to the sewing object S, and the feed belts 21 move in the Y-axis direction during the period in which the sewing needle 3 is withdrawn from the sewing object S. In addition, the needle drive control part 36 controls the needle drive part 12 so that the sewing needle 3 does not move in the Y-axis direction.

Figure 3:
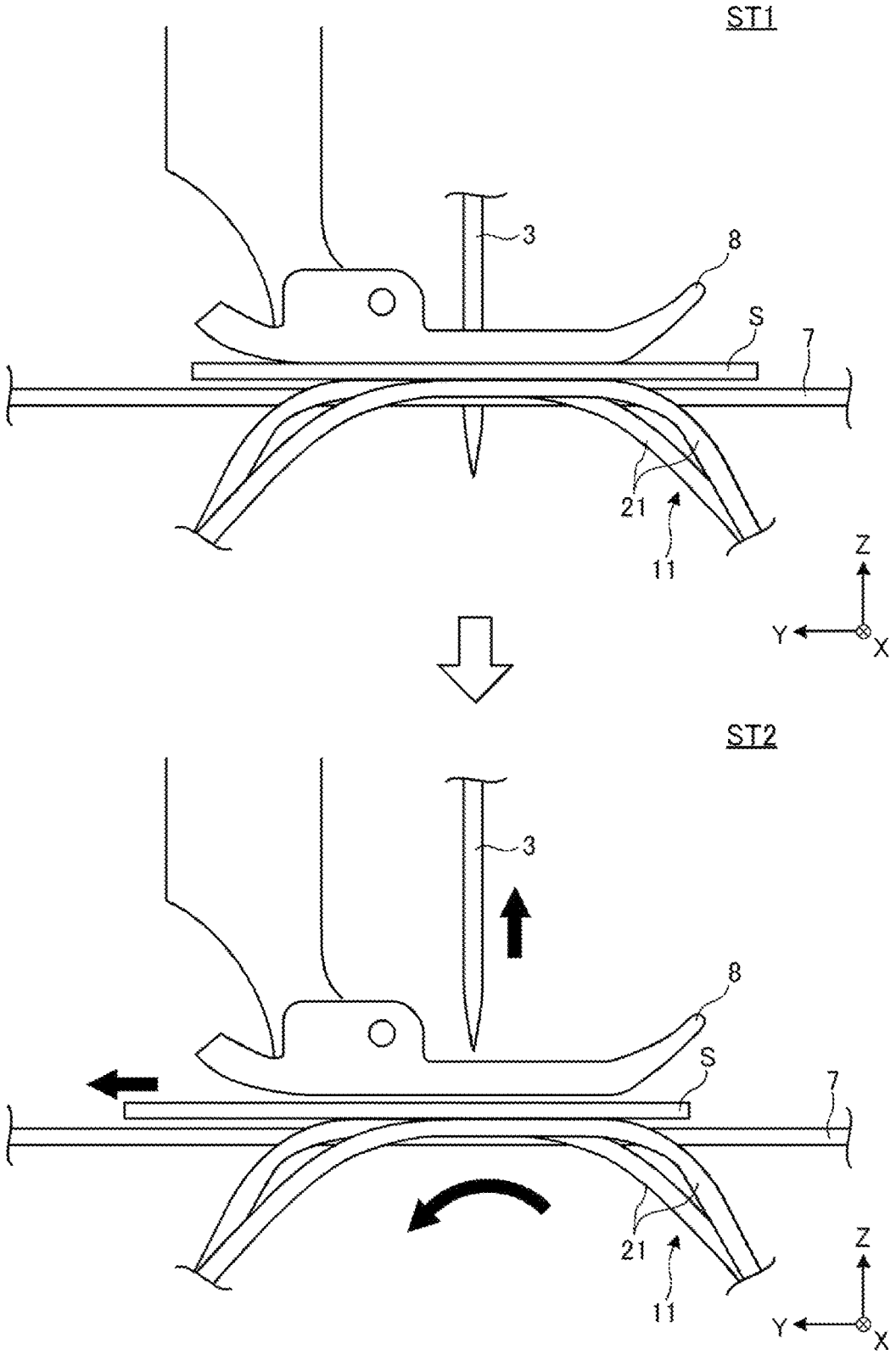
FIG. 3 is a view illustrating an example of an operation in a belt feed mode.

FIG. 3 is a view illustrating an example of an operation in the belt feed mode. As shown in FIG. 3, through the control of the belt drive control part 34 and the needle drive control part 36, in the belt feed mode, the sewing object S is not fed in the Y-axis direction during a period ST1 in which the sewing needle 3 is stuck to the sewing object S. In addition, during a period ST2 in which the sewing needle 3 is withdrawn from the sewing object S, the sewing object S is fed in the Y-axis direction by the feed belts 21.

Figure 4:
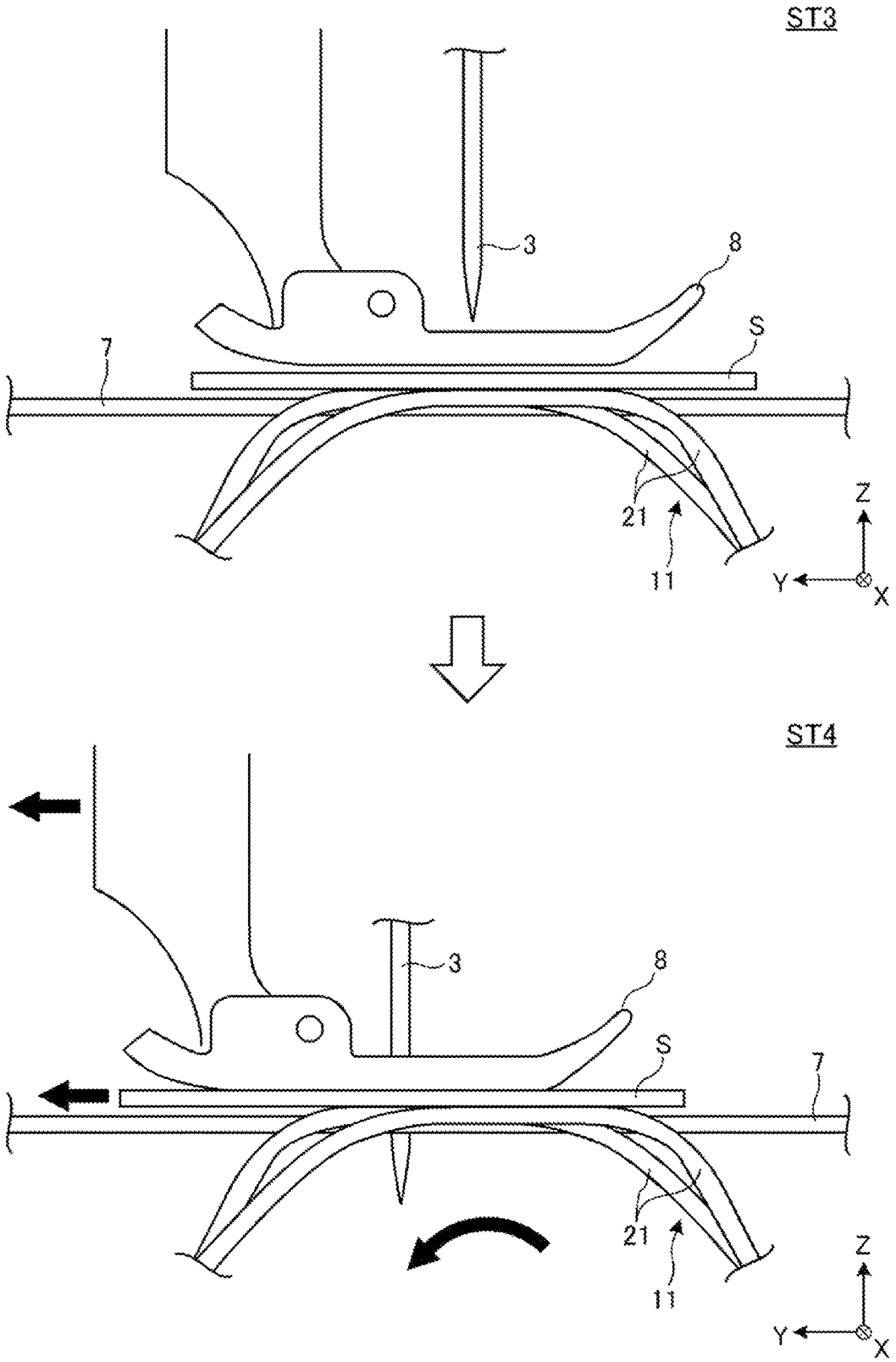
FIG. 4 is a view illustrating an example of an operation in a need feed mode.

FIG. 4 is a view illustrating an example of an operation in the need feed mode. As shown in FIG. 4, through the control of the belt drive control part 34 and the needle drive control part 36, in the needle feed mode, the sewing object S is not fed in the Y-axis direction during a period ST3 in which the sewing needle 3 is withdrawn from the sewing object S. In addition, during a period ST4 in which the sewing needle 3 is stuck to the sewing object S, the sewing needle 3 and the feed belts 21 move synchronously in the Y-axis direction, and the sewing object S is fed in the Y-axis direction in the state in which the sewing needle 3 is stuck to the sewing object S.

Figure 5:
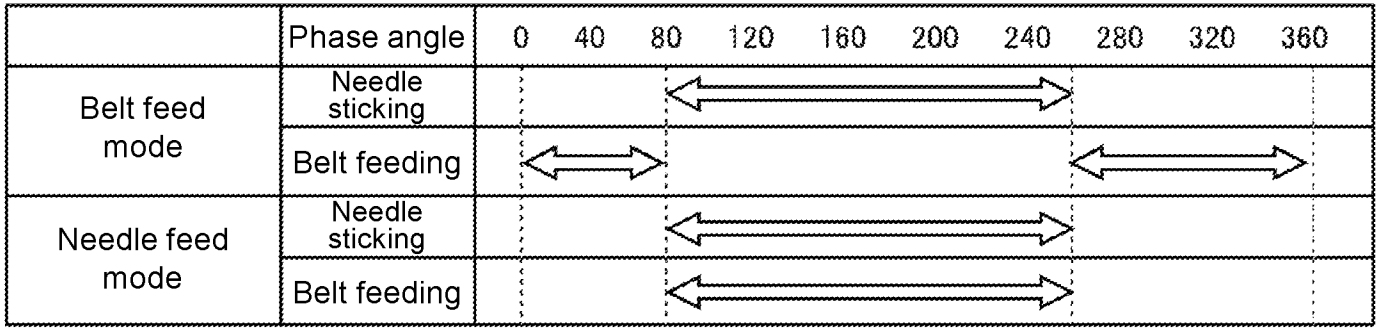
FIG. 5 is a view illustrating an example of timings that a sewing needle, a pressing member, and feed belts are synchronized.

FIG. 5 is a view illustrating an example of timings that the sewing needle 3 and the feed belts 21 are synchronized. As shown in FIG. 5, it is set that the respective parts are synchronized based on the phase angles of the motors that drive the sewing needle 3 and the feed belts 21. Specifically, in both of the belt feed mode and the needle feed mode, the motor 10 is controlled, so that the sewing needle 3 is stuck to the sewing object S during a period in which the phase is between 80° and 260°. In such case, other operations are controlled in accordance with the motor 10. Accordingly, in both of the belt feed mode and the needle feed mode, the sewing needle 3 and the feed belts 21 can be easily synchronized.

According to the above, the sewing machine 1 according to the embodiment includes: the sewing needle 3, held by the needle rod 4 and holding the upper thread to move reciprocally; the shuttle 9, holding the bobbin which is accommodated in the bobbin case and in which the lower thread is wound, and cooperating with the sewing needle to form a seam SE; the pressing member 8, pressing the sewing object S disposed at the sewing position PS immediately below the sewing needle 3; the feed mechanism 11, in which the endless feed belts 21 feeding the sewing object S disposed at the sewing position PS from the sewing position PS toward the Y-axis direction are disposed on two sides with respect to the sewing position PS in the X-axis direction orthogonal the Y-axis direction, and in which the belt drive part 22 is provided, the belt drive part 22 independently driving the feed belts 21 on the −X side and the feed belts 21 on the +X side in the X-axis direction with respect to the sewing position PS; the needle driving part 12, provided separately from the belt drive part 22 and moving the sewing needle 3 in the Y-axis direction; and the control part 30, exerting control so that the belt drive part 22 and the needle drive part 12 operate independently.

According to the configuration, since the belt drive part 22 and the needle drive part 12 are controlled to operate independently, the specification of feeding the sewing object S can be switched as the control mode. Accordingly, it is easy to switch the specification of delivering the sewing object S without extensively recombining the sewing machine 1.

In the sewing machine 1 according to the embodiment, the control part 30 performs, as a mode of feeding the sewing object S, the belt feed mode that controls the needle drive part 12 and the belt drive part 22, so that the sewing needle 3 and the feed belts 21 do not move in the Y-axis direction during the period in which the sewing needle 3 is stuck to the sewing object S, and the sewing needle 3 does not move in the Y-axis direction and the feed belts 21 move in the Y-axis direction during the period in which the sewing needle 3 is withdrawn from the sewing object S. According to the configuration, the feed belts 21 can feed the sewing object S reliably.

In the sewing machine 1 according to the embodiment, the control part 30 performs, as a mode of feeding the sewing object S, the needle feed mode that controls the needle drive part 12 and the belt drive part 22, so that the sewing needle 3 and the feed belts 21 move synchronously by the predetermined distance in the Y-axis direction during the period in which the sewing needle 3 is stuck to the sewing object S, and the sewing needle 3 and the feed belts 21 do not move in the Y-axis direction during the period in which the sewing needle 3 is withdrawn from the sewing object S. According to the configuration, when sewing is performed in the state in which multiple sewing objects S overlap, the sewing objects S can be suppressed from being shifted in the horizontal direction.

In the sewing machine 1 according to the embodiment, the control part 30 exerts control to be able to switch between the belt feed mode and the needle feed mode. The belt feed mode controls the needle drive part 12 and the belt drive part 22, so that the sewing needle 3 and the feed belts 21 do not move in the Y-axis direction during the period in which the sewing needle 3 is stuck to the sewing object S, and the sewing needle 3 does not move in the Y-axis direction and the feed belts 21 move in the Y-axis direction during the period in which the sewing needle 3 is withdrawn from the sewing object S. The needle feed mode controls the needle drive part 12 and the belt drive part 22, so that the sewing needle 3 and the feed belts 21 move synchronously by the predetermined distance in the Y-axis direction during the period in which the sewing needle 3 is stuck to the sewing object S, and the sewing needle 3 and the feed belts 21 do not move in the Y-axis direction during the period in which the sewing needle 3 is withdrawn from the sewing object S. According to the configuration, the belt feed mode and the needle feed mode can be easily switched as a change of the control mode.

The technical scope of the disclosure is not limited to the above embodiments, and changes can be made as appropriate without departing from the spirit of the disclosure.

What is claimed is:

1. A sewing machine, comprising:

a sewing needle, held by a needle bar and holding an upper thread to move reciprocally;

a shuttle, holding a bobbin which is accommodated in a bobbin case and in which a lower thread is wound, and cooperating with the sewing needle to form a seam;

a pressing member, pressing a sewing object disposed at a sewing position immediately below the sewing needle;

a feed mechanism, in which endless feed belts feeding the sewing object disposed at the sewing position from the sewing position along a first direction are disposed on two sides with respect to the sewing position in a second direction orthogonal to the first direction, and in which a belt drive part is provided;

a needle drive part, provided separately from the belt drive part, and moving the sewing needle in the first direction; and a control part, exerting control so that the belt drive part and the needle drive part operate independently.

2. The sewing machine as claimed in claim 1, wherein the control part performs, as a mode of feeding the sewing object, a belt feed mode that controls the needle drive part and the belt drive part, so that the sewing needle and the feed belts do not move in the first direction during a period in which the sewing needle is stuck to the sewing object, and the sewing needle does not move in the first direction and the feed belts move in the first direction during a period in which the sewing needle is withdrawn from the sewing object.

3. A sewing machine, comprising:

a sewing needle, held by a needle bar and holding an upper thread to move reciprocally;

a shuttle, holding a bobbin which is accommodated in a bobbin case and in which a lower thread is wound, and cooperating with the sewing needle to form a seam;

a pressing member, pressing a sewing object disposed at a sewing position immediately below the sewing needle;

a feed mechanism, in which endless feed belts feeding the sewing object disposed at the sewing position from the sewing position along a first direction are disposed on two sides with respect to the sewing position in a second direction orthogonal to the first direction, and in which a belt drive part is provided;

a needle drive part, provided separately from the belt drive part, and moving the sewing needle in the first direction; and a control part, exerting control so that the belt drive part and the needle drive part operate independently, wherein the control part performs, as a mode of feeding the sewing object, a needle feed mode that controls the needle drive part and the belt drive part, so that the sewing needle and the feed belts move synchronously by a predetermined distance in the first direction during a period in which the sewing needle is stuck to the sewing object, and the sewing needle and the feed belts do not move in the first direction during a period in which the sewing needle is withdrawn from the sewing object.

4. A sewing machine, comprising:

a sewing needle, held by a needle bar and holding an upper thread to move reciprocally;

a shuttle, holding a bobbin which is accommodated in a bobbin case and in which a lower thread is wound, and cooperating with the sewing needle to form a seam;

a pressing member, pressing a sewing object disposed at a sewing position immediately below the sewing needle;

a feed mechanism, in which endless feed belts feeding the sewing object disposed at the sewing position from the sewing position along a first direction are disposed on two sides with respect to the sewing position in a second direction orthogonal to the first direction, and in which a belt drive part is provided;

a needle drive part, provided separately from the belt drive part, and moving the sewing needle in the first direction; and a control part, exerting control so that the belt drive part and the needle drive part operate independently, wherein the control part is able to switch between a belt feed mode and a needle feed mode, the belt feed mode controls the needle drive part and the belt drive part, so that the sewing needle and the feed belts do not move in the first direction during a period in which the sewing needle is stuck to the sewing object, and the sewing needle does not move in the first direction and the feed belts move in the first direction during a period in which the sewing needle is withdrawn from the sewing object, and the needle feed mode controls the needle drive part and the belt drive part, so that the sewing needle and the feed belts move synchronously by a predetermined distance in the first direction during the period in which the sewing needle is stuck to the sewing object, and the sewing needle and the feed belts do not move in the first direction during the period in which the sewing needle is withdrawn from the sewing object.

* * * * *